United States Patent [19]

Krus

[11] 3,976,318

[45] Aug. 24, 1976

[54] BURGLAR-PROOF LOCK PROTECTOR

[76] Inventor: Joseph W. Krus, 1301 NE. Miami Gardens Drive, Apt. 1024W, North Miami Beach, Fla. 33179

[22] Filed: Sept. 22, 1975

[21] Appl. No.: 615,417

[52] U.S. Cl. ..... 292/346; 70/417; 70/418; 70/DIG. 56

[51] Int. Cl.[2] ..... E05B 17/00

[58] Field of Search ..... 70/417, 418, 423, 447, 70/DIG. 43, DIG. 56, DIG. 63; 292/346

[56] References Cited

UNITED STATES PATENTS

| | | | |
|---|---|---|---|
| 1,814,961 | 7/1931 | Phillips | 292/346 |
| 2,144,075 | 1/1939 | Mora | 292/346 |
| 2,798,753 | 7/1957 | Wade | 292/346 X |
| 3,645,045 | 2/1972 | Gervis | 292/346 X |

*Primary Examiner*—Robert L. Wolfe
*Attorney, Agent, or Firm*—Salvatore G. Militana

[57] ABSTRACT

A burglar-proof protector for locks mounted on doors having a cover enshrouding the lock and secured to the door with an opening in the center of the cover for receiving a key to permit actuation of the lock. A plate member is secured to the jamb of the doorway adjacent the cover to prevent manipulation of a tool between the cover and the jamb whereby the jamb may be damaged and the bolt retracted without the use of a key.

3 Claims, 3 Drawing Figures

BURGLAR-PROOF LOCK PROTECTOR

BACKGROUND OF THE INVENTION

1. Field of the Invention

This invention relates to protecting devices for locks mounted on a door and is more particularly directed to such a device provided with a plate mounted on the jamb of a door to prevent an intruder gaining access to the bolt in opening the door without use of the key.

2. Description of the Prior Art

In order to prevent intruders, burglars and the like from gaining access through a locked door the present trend is to place a cover over the lock and provide a centrally disposed opening to receive the key when it is desired to actuate the lock. However, due to the fact that the main access door to a home or apartment swings inwardly, the cover must be spaced from the jamb in order to clear the jamb when opening and closing the door. This opening between the jamb and the cover permits the intruder to insert a tool and damage the jamb sufficiently to permit access to the bolt. The intruder then manipulates the bolt to thereby open the door without the use of a key. The present invention contemplates the use of a cover for a lock mounted on a door but preventing a person from being able to force open the door without the use of a key.

BRIEF SUMMARY OF THE INVENTION

Therefore a principal object of the present invention is to provide a burglar-proof lock protector having a cover secured to the door over a lock and a plate mounted on the jamb adjacent the cover to prevent forming a space between the jamb and cover that would permit a person to insert a tool therethrough and open the door without the use of a key.

Another object of the present invention is to provide a burglar-proof lock protector for a lock mounted on a door whose jamb is fabricated of wood or hollow steel whereby the jamb can be damaged adjacent the lock to provide access to the bolt and permit the opening of the door without use of a key.

A further object of the present invention is to provide a burglar-proof lock protector that is simple in construction, readily mounted on a door without the use of special tools and most effective to prevent a burglar from opening the door without a key.

With these and other objects in view, the invention will be best understood from a consideration of the following detailed description taken in connection with the accompanying drawing forming a part of this specification, with the understanding, however, that the invention is not confined to any strict conformity with the showing of the drawing but may be changed or modified so long as such changes or modifications mark no material departure from the salient features of the invention as expressed in the appended claims.

DETAILED DESCRIPTION OF THE PREFERRED EMBODIMENT

Figure 1:
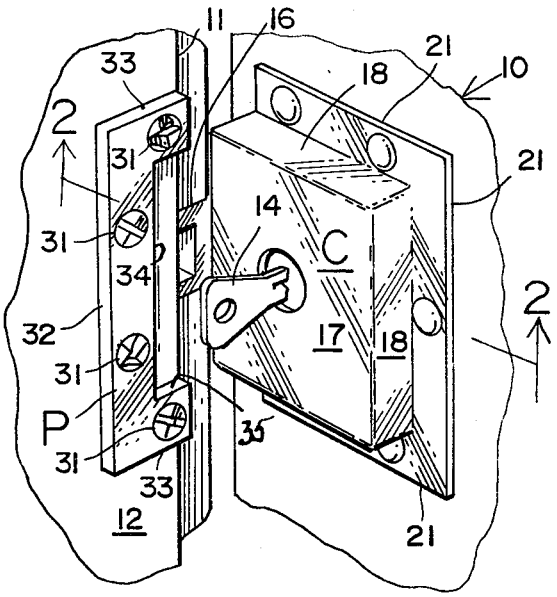
FIG. 1 is a fragmentary perspective view of a door in a slightly open position having my burglar-proof lock protecting device shown mounted over the lock.
Figure 3:
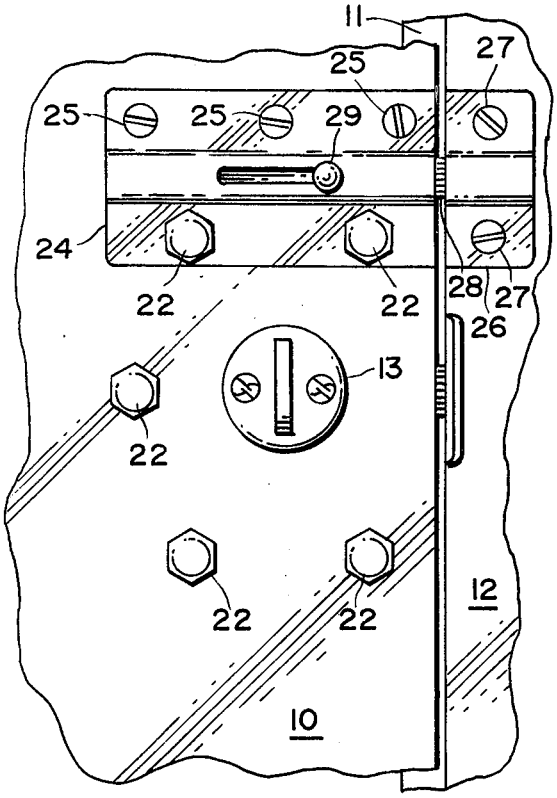
FIG. 3 is a fragmentary plan view showing the inside of the door.
Figure 2:
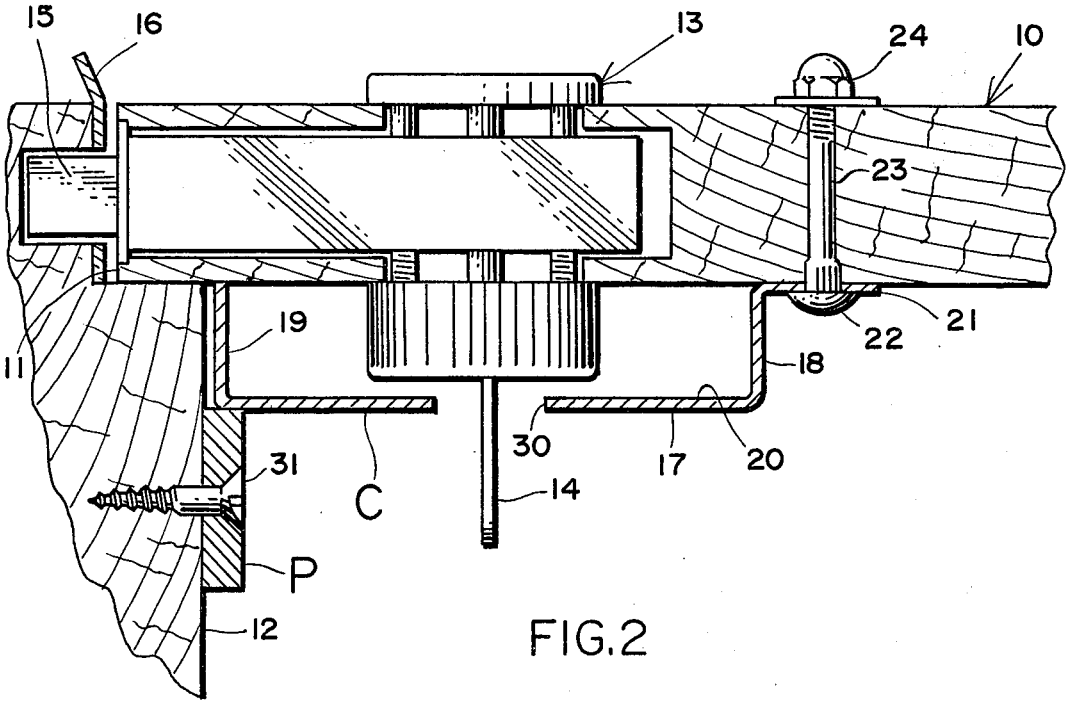
FIG. 2 is a cross sectional view taken along the line 2—2 of FIG. 1 with the door shown in a completely closed position.

Referring to the drawing wherein like numerals are used to designate similar parts throughout the several views, the numeral 10 refers to an outside door which opens inwardly to close against a stop 11 of a door frame jamb 12. Shown mounted on the door 10 is a conventional dead lock 13 which requires a key 14 to extend or retract the bolt 15 with relation to the strike plate 16 in order to lock and unlock the door 10.

In order that a burglar be able to force open the door 10 without the use of a key, he must either demolish the lock 13 so as to have access to the bolt 15 and retract it by hand or to insert a bar or a jimmy between the door 10 and door frame 12 at the position of the bolt 15 and pry the door 10 to an open position.

The present invention which consists of a lock cover member C and plate P prevents a burglar from having access to the lock 13 or to be able to use a jimmy. The cover C consists of a top plate member 17 with an opening 30 and having side walls 18 and 19 extending on all four sides of the top wall 17 and at right angles thereto to form a chamber 20 for enclosing that portion of the lock 13 that extends beyond the outside surface of the door 10. Three side walls 18 are provided with flanges 21 that engage the outer surface of the door 10, the fourth side wall 19 positioned adjacent to the door jamb 12 does not have a flange, since the side wall 19 must be positioned as close to the door jamb 12 as possible. The flanges 21 are provided with openings 23 for receiving bolts 22 that extend through the door 10 with nuts 24 threaded thereon. Two of the uppermost bolts 22 extend through openings in a conventional slide bolt mounting 24 secured to the inside surface of the door 10. The slide bolt mounting 24 is additionally secured to the door 10 by screws 25. A lock plate 26 fastened to the door jamb 12 by screws 27 receives the slide bolt 28 to also lock the door 10 when the handle 29 is pushed sideways to cause the slide bolt 28 to span the juncture between the door 10 and door jamb 12.

Inasmuch as the door 10 is of considerable thickness hinged along one side, the other side must be spaced from the door frame 12 in order that it be brought to a closed position in coplanar relation with the door frame 12. Likewise the side wall 19 of the cover member C must be sufficiently spaced from the door frame 19 to not engage the jamb 12 when the door 10 is swung to its closed position or when commenced to swing to its open position. This space between the jamb 12 and the side wall 19 of the cover member C would permit a would be burglar to insert a tool or jimmy therein and crush the cover C or the jamb 12 at the position of the bolt 15. To frustrate a person from so doing, a U-shaped plate member P fastened to the door jamb 12 by a plurality of one-way screws 31.

The U-shaped plate member P consists of a main portion 32 that extends vertically along the door jamb 12 at each end of which extend the leg portion 33 at right angles thereto to form a slot 34 for the lock cover C to seat therein. When the door 10 is in its closed position, the lock cover C will fit snugly in the slot 34 with the inner edge of the main portion 32 engaging the front wall 17 of the cover member C. The inner edges 35 of the leg portions 33 will engage the top and bottom walls 18 of the cover member C. The plate member P will span the spaces between the cover member C and the jamb 12 so that a tool or jimmy cannot be inserted in said spaces, and thereby prevent any person from opening a locked door without the use of a key. The only way the door 10 can be opened from the outside is by means of a key 14 being inserted through the opening 30 into the lock 13 to effect the operation of the lock mechanism in retracting the bolt 15 from the striker plate 16.

What I claim as new and desire to secure by Letters Patent is:

1. A burglar-proof protecting device for a lock mounted on a door hinged to a door frame comprising a plate member, side walls extending at right angle to said plate member forming a chamber for receiving said lock, flanges extending along the edges of said side walls, means fastening said flanges to said door, an opening in said plate member for exposing a key receiving porton of said lock, one of said side walls being positioned in substantially parallel and spaced relation to said door frame and plate means secured to said door frame and extending about said device and spanning said space between said door frame and said device preventing the insertion of a tool into said space for the purpose of opening said door without a key.

2. The structure as recited by claim 1 wherein said plate means is substantially U-shaped consisting of a main body portion extending along said plate member and a leg portion at each end of said body portion extending along said side walls of said protecting device.

3. The structure as recited by claim 2 taken in combination with a manual slide bolt mounted on said door in proximity of said lock protecting device, said slide bolt having openings and said flange fastening means extending through said openings for securing said slide bolt to said door.

* * * * *